United States Patent [19]

Gernez

[11] 4,376,136

[45] Mar. 8, 1983

[54] METHOD FOR ELECTROSTATICALLY DEPOSITING POWDER IN SEVERAL DIFFERENT LAYERS ON OBJECTS

[75] Inventor: Alain Gernez, Orleans, France

[73] Assignee: Societe Anonyme dite: Compagnie Europeenne Pour L'Equipement Menager "Cepem", Paris, France

[21] Appl. No.: 267,889

[22] Filed: May 28, 1981

[30] Foreign Application Priority Data

Jun. 13, 1980 [FR] France ..... 80 13161

[51] Int. Cl.[3] ..... B05D 1/04

[52] U.S. Cl. ..... 427/33; 427/47; 427/131; 427/132; 427/345; 427/405; 427/409

[58] Field of Search ..... 427/33, 47, 131, 132, 427/345, 405, 409

*Primary Examiner*—Bernard D. Pianalto

*Attorney, Agent, or Firm*—Kenyon & Kenyon

[57] ABSTRACT

Apparatus for electrostatically depositing powder on objects which move continuously through a powder-depositing booth of modular type having a powder depositing module (B) on each side of which there is an air filter module (A and C); the powder depositing module (B) has two compartment (B1, B2) next to each other each compartment having a distinct powder store tank (11, 12) which allows two layers of powder to be applied successively to the object to be treated. Application to enamelling objects Figure to be published: FIG. 2.

4 Claims, 6 Drawing Figures

METHOD FOR ELECTROSTATICALLY DEPOSITING POWDER IN SEVERAL DIFFERENT LAYERS ON OBJECTS

The invention relates to a method and apparatus for electrically depositing powder on objects which move continuously by means of a conveyor through at least two powder depositing booths. Such booths are described in published French patent applications Nos. 2467022 and 2442080, and European patent application No. 81101408.3. These booths each comprise a central powder deposition module flanked by two air filter modules with ionization compartments between successive modules to ionize the powder.

BACKGROUND OF THE INVENTION

In some cases, it is necessary to apply at least two superposed layers of different powders, e.g. for vitrified enamel the layers may be as follows:

an undercoat of enamel which contains ingredients for adherence to the support (which is an ordinary metal sheet) and a layer herein called a covering layer of enamel which contains the decorative colouring. A solution known per se consists in placing two powder depositing booths one after the other to carry out this operation.

The difficulties or the complications of this solution are numerous and impede the development of the method:

the undercoat must be very thin for an enamel (about 20 microns), very regular and not very electrostatically charged. This usually requires mechanical equipment moving spray guns vertically in an up and down movement; and the covering layer must not be polluted by the undercoat which is of a very different chemical nature. Now, in the covering layer depositing booth, the act of depositing said covering layer tends to remove particles of undercoat. Since the non-deposited powder is entirely recycled, the covering layer is polluted thereby.

A known solution consists in depositing the covering layer in two steps, also with up and down movements of spray guns:

step one=deposit recycled powder (only);

step two=deposit new powder (only).

This solution has several disadvantages:

considering the high percentage of powder that is recycled, particularly enamel powder, the quantity of new powder needed to make good powder consumption may be too small to cover properly the layer of polluted recycled powder deposited in the first step; and the new enamel powder and the recycled enamel powder have different electric characteristics which can cause drawbacks when depositing them separately and, in particular, can lead to a defect called herein'-'counter-emission".

Preferred implementations of the present invention overcome these disadvantages and complications by providing a method and apparatus which are highly reliable and are inexpensive to provide, in particular by avoiding mechanical equipment of the kind which increases maintenance costs.

SUMMARY OF THE INVENTION

The invention provides a method of electrostatically depositing powder on objects which are moved continuously by means of a conveyor through at least two powder depositing booths, wherein in the first booth the powder is firstly dispersed in a first chamber and then electrostatically charged in two chambers which are contiguous with the first and which are located upstream and downstream therefrom, and wherein in each powder depositing booth which follow the first booth, powder is pre-applied exclusively by electrostatic forces before entering an electrostatic powder depositing chamber.

In a preferred implementation of said method two successive layers of powder are applied in at least one booth which follows the first booth, by spraying in two compartments which are next to each other in a powder depositing chamber. Greater air pressure (or greater air flow rate) is used in the second compartment. Magnetic particals are separated from the powder by sifting upstream and downstream from the powder depositing chamber.

The invention also provides apparatus for electrostatically depositing powder on objects which move continously through at least two treatment booths, each booth having a powder depositing module and an air filter module, wherein the powder deposition module of each booth following the first booth includes a powder depositing chamber which comprises two compartments next to each other, each compartment having a distinct powder storage tank which allows two layers of powder to be applied successively to the object to be powdered.

In this apparatus the powder depositing module of the second booth has a powder depositing chamber which has two compartments next to each other, each powder depositing compartment having a distinct storage tank allowing two layers of powder—one liable to be polluted and the other clean—to be applied successively on the object to be treated.

BRIEF DESCRIPTION OF THE DRAWINGS

A preferred embodiment of the invention is described with reference to the accompanying drawings in which.

DESCRIPTION OF PREFERRED EMBODIMENT

Figure 1:
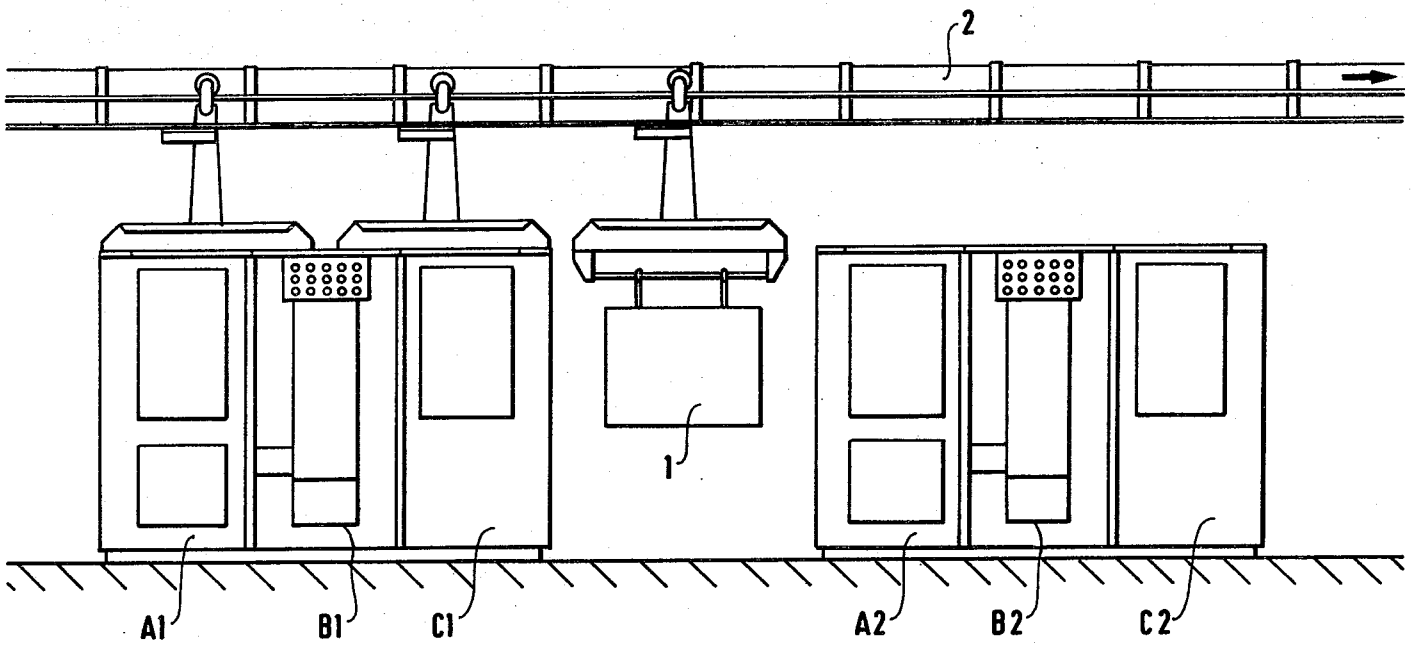
FIG. 1 is an elevation of the two successive booths under a conveyor for parts to be powdered. The undercoat booth, or first booth, is located to the left of the figure, and the covering layer booth, or second booth, is located to the right of the figure, with the direction of movement of the parts 1 being from left to right as shown by an arrow.
Figure 2:
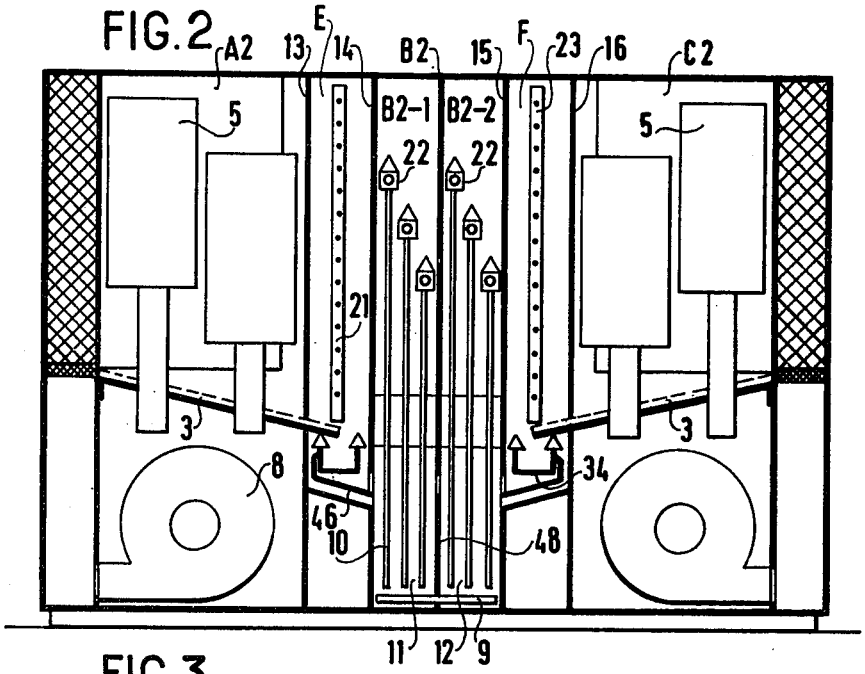
FIG. 2 is an elevation in cross-section of the second booth in accordance with the invention. Said second booth has two contiguous powder depositing compartments and two sifters disposed in compartments adjacent to the powder depositing compartments.
Figure 3:
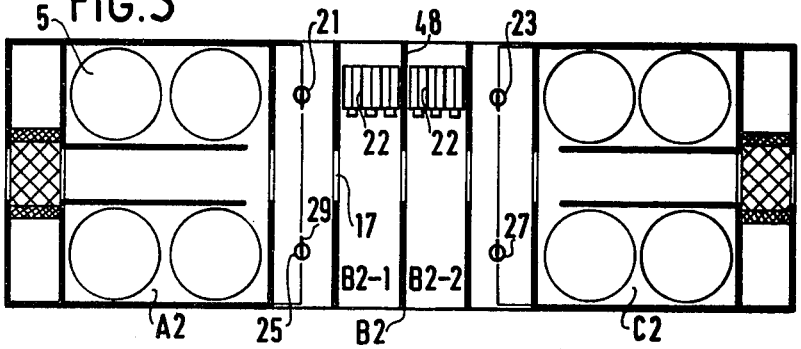
FIG. 3 is a plan of the booth of FIG. 2.

In the embodiment illustrated in the figures, parts 1 transported by a conveyor 2 pass through two powder depositing booths, each of which has three modules, A, B, C, labelled:

A1, B1, C1 for the first booth; and

A2, B2, C2 for the second booth.

Modules A serve as inlet air locks, modules B as chambers for depositing powder and contain powder depositing units 22, and modules C as outlet air locks. Module B2 is divided by a partition 48 into two powder depositing compartments B2-1 and B2-2. Module B1 differs from module B2 only by the absence of this partition. The inlet modules A and the outlet modules C contain cylindrical vertical filters 5 of which there are, for example, four per module. A fan 8 provides aspiration through the filters, and an unclogging unit (not shown) serves to recondition the filters.

A fluidization unit 3 situated at the bases of the filters recovers the powder which falls from these filters and returns it to powder stores 11, 12 situated at the bases of the compartments B2-1, B2-2 of the booth. These compartments each contain a fluidization unit 9.

The powder depositing units 22 may be of any type, e.g. electrostatic or non-electrostatic spray guns. The powder depositing units 22 are connected to dippers 10 which draw the powder directly from one of the powder storage tanks 11, 12, there being one tank powder depositing compartment. The units 22 are topped by caps which prevent powder from gathering on them.

Each of the powder depositing modules B1 and B2 has two ionization compartments E and F which are contiguous with the powder depositing chamber and with the inlet and outlet modules A and C respectively.

In the first booth, the powder is initially dispersed in the first powder depositing module B1 and is then electrostatically charged in the two adjacent ionization chambers E and F, which are respectively upstream and downstream therefrom. In the second booth powder is pre-applied by electrostatic forces in the compartments E before the objects to be powdered enter the powder depositing chamber B2.

An ionization compartment is constituted by solid walls 13, 14, 15, 16 which leave a central passage 17 for the parts to be treated. These walls constitute obstacles in the path of the powder and thereby further confine the powder in the powder depositing module B, causing considerable loss of head when the powder passes from the powder depositing chamber B to the filter chambers A or C. These obstacles oblige the powder which takes part in this transfer to move towards the central axis of the booth and thus towards the parts which move through the booth. The fraction of powder which is still charged (if electrostatic spray guns are used) is redeposited on the parts. The ionization compartments E and F further include ionization units 21, 23, 25 and 27 constituted by insulating tubes extending vertically up the entire height of the booth. Pins 29 pass through holes in these tubes, leaving a space around the pins where they pass through the holes. The pins are fixed on the tube along the generatrix that is furthest from the holes by a fixing means such as nailing or the like. The pins 29 point towards the centre of the booth perpendicularly to the path followed by the parts, and pass through an electrically conductive member which is disposed inside the tube and is connected to the high-tension supply. The high-tension supply is an electrostatic generator which can be the same as that used for the spray guns in module B; the pins 29 are thus in contact with the conductive member which brings them to high potential for re-ionizing the powder. The conductive member is constituted by a helical spring suspended along the axis of the tube with the pins 29 passing between its turns. The conductive member could alternatively be constituted by metal braiding. The pins are disposed along a generatrix along the entire height of the tube; the pins can be spaced at a spacing lying between 10 mm and 100 mm apart, for example.

To avoid electrostatic leakage, the insulating tube 21 is closed at one end by an insulating plug through which the high-tension input conductor passes; the other end of said insulating tube is connected to a compressed air supply unit.

During operation, the pins are brought to a high electric potential by means of the conductive member so as to ionize the powder, the tube being supplied with compressed air which, on leaving via the holes surrounding the pins, prevents powder from being deposited on said pins, as this would impair proper ionization of the air and of the powder in the compartment.

Figure 4:
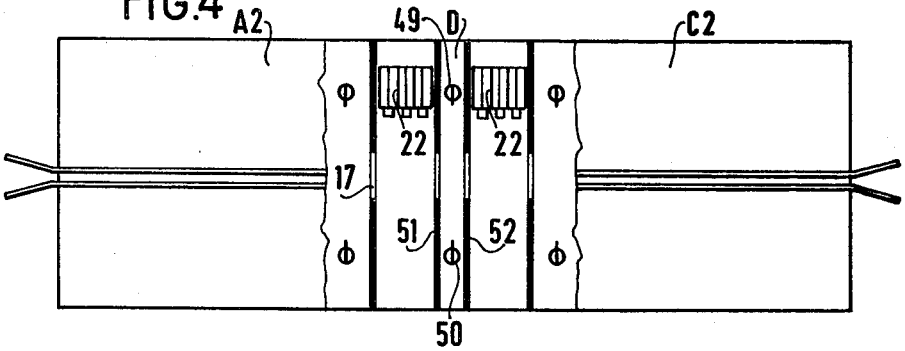
FIG. 4 is a partial plan of a booth which has an ionization compartment sandwiched between the powder depositing compartments.
Figure 5:
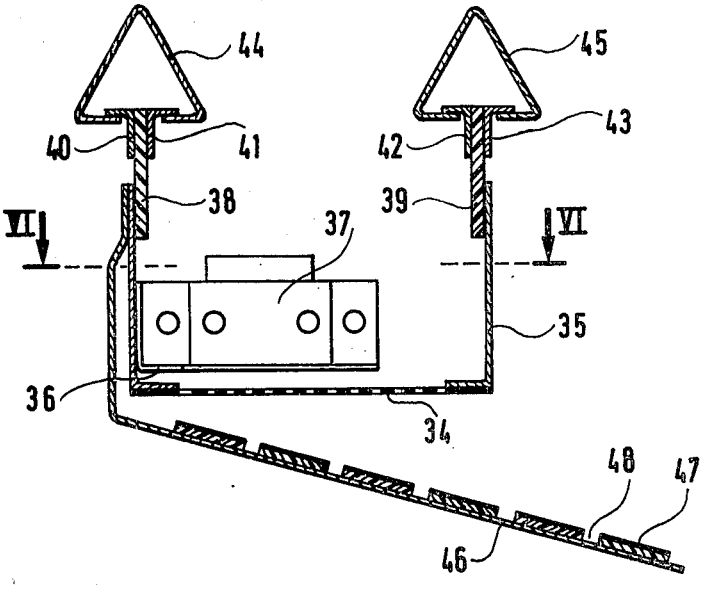
FIG. 5 is a transverse cross-section of a sifter for separating magnetic particles.
Figure 6:
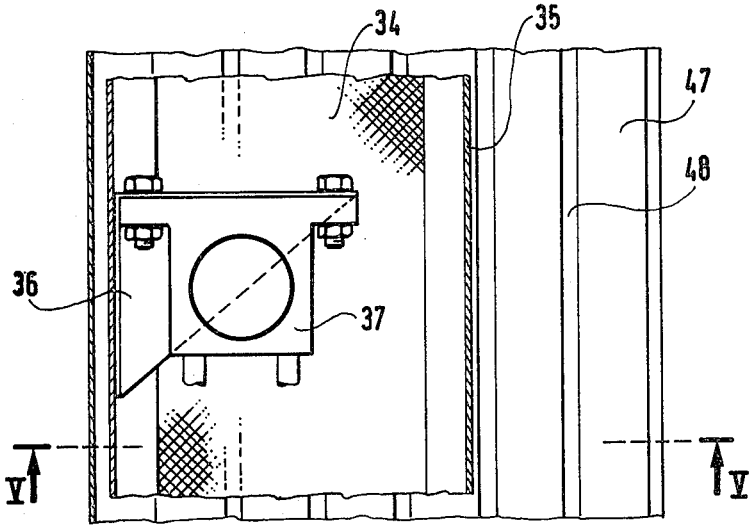
FIG. 6 is partial plan corresponding to FIG. 5.

A sifter preferably of the type illustrated in FIGS. 4 and 5 is disposed in the lower portion of each ionization compartment E, F; each sifter has a wire gauze 34 glued onto a metal frame 35 which is subjected to vibrations caused by a pneumatic vibrator 37 via a bracket 36. The resilient suspension of the sifter is provided by two indiarubber bands 38 and 39 which also provide sealing against an overflow of powder. These bands are fixed on brackets 40, 41, 42 and 43 which can slide longitudinally in two section bars 44 and 45 which prevent powder from being retained. This makes it possible to remove the sifters from the booth for cleaning simply by sideways extraction through two doors in module B. The separation of the magnetic particles and the transfer of powder towards the storage tanks 11, 12 which constitute the bottom of the module B is performed by an inclined metal sheet 46 subjected to the vibrations of the sifter and provided with parallel magnetic indiarubber bands 47 glued to the metal sheet. These bands 47 are separated by gaps 48 which allow the magnetic particles to gather between two cleaning operations.

The embodiment of the sifter illustrated in FIG. 5 provides high-efficiency sifting and separation of the magnetic particles of the powder.

The installation described provides the following advantages:

the booth has two entirely independent air filter compartments A and C. This makes it possible to treat the powder polluted by possible removal of undercoat powder (inlet module A2) separately from the clean powder (outlet module C2). The booth has a powder depositing chamber and a powder storage tank separated in two equal or unequal parts B2-1, B2-2 by a wall 48 situated in a plane perpendicular to the axis of advance of the parts; this allows any undercoat powder, coming off the part to fall preferentially into the tank which is contiguous with the inlet.

The compressed air flow rate in the depositing half chamber B2-2 contiguous to the outlet module is higher than that in the half depositing chamber close to the inlet module. This flow rate can be increased:

Preferably by making the powder pumps feeding the spray guns inject air at pressures which are generally higher in the outlet chamber;

or else by allowing an additional quantity of compressd air into this chamber.

Sifting the powder which comes from the inlet module and from the outlet module through two sifters which also separate the magnetic particles avoids the polluted powder in the inlet module from being mixed with the clean powder in the outlet module. The device for separating the magnetic particles also transfers the powder sideways between the sifter and the half powder tank corresponding to this powder.

FIG. 4 illustrates a variant in which the second booth has a powder ionization compartment D located between the two powder deposition half chambers B2-1 and B2-2 by means of two walls 51, 52 so as to further reduce the exchanges of powder between the depositing half chambers. The compartment D has two ionization tubes 49 and 50 whoe ionization points are turned towards the axis along which the parts to be treated are conveyed.

The method and the device together can be used in particular to apply enamel powder in accordance with the "two layers and one baking" method on ordinary sheet steel instead of on decarburized sheet steel in the case of "direct" application of the enamel.

This method can also be used in apparatus such as described in published French Patent application No. 2 444 508 which describes how colour grading of enamel powder can be obtained. In this case, the apparatus has three successive booths:

a first booth for the undercoat of enamel in which the undercoat forms a priming layer on the steel sheet;

a second booth for the first covering layer, which booth has the characteristics of the covering layer booth set forth hereinabove; and a third booth for the second covering layer applied by the back of the part, said booth also has the above-mentioned characteristics, by which a colour grading effect can be obtained.

I claim:

1. A method of depositing successive layers of powder on objects, the method including providing at least first and second powder depositing booths, conveying objects along a path sequentially through said at least first and second powder depositing booths, electrostatically depositing an underlayer of a first powder in the first booth, and electrostatically depositing a cover layer of a second powder in the second booth, wherein the improvement comprises:

providing said first powder depositing booth with a first chamber, a second chamber located contiguously upstream of the first chamber with respect to the direction of movement of the objects along said path, and a third chamber located contiguously downstream of the first chamber with respect to the direction of movement of the objects along said path;

providing the second powder depositing booth with an electrostatic powder depositing chamber and an additional chamber located contiguously upstream of the electrostatic powder depositing chamber with respect to movement of the objects along said path; and wherein the step of electrostatically depositing the first powder comprises dispersing the first powder in said first chamber of the first booth, diffusing a portion of the powder dispersed in the first chamber into said second and third chambers, and electrostatically charging in the second and third chambers at least part of the portions of the first powder diffused from the first chamber, such that part of the charged portions of the first powder is deposited on the objects in an even thin underlayer as the objects pass through the second and third chambers; and the step of electrostatically depositing the second powder comprises dispersing and electrostatically charging the second powder in said electrostatic powder depositing chamber of the second booth, diffusing a portion of the second powder into said additional chamber from said electrostatic powder depositing chamber, and electrostatically recharging in said additional chamber of the second booth at least part of the portion of the second powder diffused from said electrostatic powder depositing chamber of the second booth, such that a thin layer of the second powder is applied onto each object exclusively by electrostatic attraction as the object passes through said additional chamber before entering said electrostatic powder depositing chamber of the second booth.

2. The method of claim 1 wherein the step of electrostatically depositing the second powder further comprises:

providing the second booth with a further additional chamber located contiguously downstream of the electrostatic powder depositing chamber with respect to the direction of movement of the objects along said path; diffusing a further portion of the second powder into the further additional chamber from the electrostatic powder depositing chamber; and electrostatically recharging in the further additional chamber at least part of the further portion of second powder diffused from the electrostatic powder depositing chamber, such that a further thin layer of the second powder is applied onto each object exclusively by electrostatic attraction in the further additional chamber after the object leaves the electrostatic powder depositing chamber of the second booth.

3. The method of claim 1 wherein the step of dispersing the second powder in the electrostatic powder depositing chamber in the second booth comprises:

providing the electrostatic powder depositing chamber with a first compartment and a second compartment, the second compartment being located downstream of the first compartment with respect to the direction of movement of the objects along said path;

providing a first source of the second powder and a second source of the second powder, the second source being separate from the first source;

spraying powder from the first source in the first compartment of the electrostatic powder depositing chamber;

spraying powder from the second source in the second compartment of the electrostatic powder depositing chamber;

supplying air at a first pressure to the first compartment; and supplying air at a second pressure, greater than said first pressure, to the second compartment, whereby powder from the first and second sources is applied to the objects in two successive layers, and the powder in the second compartment is not contaminated by powder from the first compartment.

4. The method of claim 2, further comprising:

providing first and second filter chambers located at the entrance and exit, respectively, of the second booth;

sifting excess undeposited powder in said first and second filter chambers to separate metal particles from the powder; and returning the sifted powder in the first and second filter chambers to the first and second sources, respectively.

* * * * *